United States Patent [19]

Pratt

[11] Patent Number: 4,483,431

[45] Date of Patent: Nov. 20, 1984

[54] DEVICE FOR DETECTING AND REJECTING INVALID COINS UTILIZING A VERTICLE COIN CHUTE AND MULTIPLE COIN TESTS

[75] Inventor: Gary A. Pratt, Sparks, Nev.

[73] Assignee: Harrah's, Inc., Reno, Nev.

[21] Appl. No.: 310,480

[22] Filed: Oct. 13, 1981

[51] Int. Cl.[3] ..... G07D 5/02; G07D 5/08

[52] U.S. Cl. ..... 194/97 A; 194/99

[58] Field of Search ..... 194/100 A, 1 K, 97 R, 194/97 A, 99, 101; 330/6; 307/309; 73/163; 324/235, 207; 338/32 H

[56] References Cited

U.S. PATENT DOCUMENTS

| | | | |
|---|---|---|---|
| 3,797,307 | 3/1974 | Johnston | 194/100 A |
| 3,921,003 | 11/1975 | Greene | 194/97 A |
| 3,978,962 | 9/1976 | Gregory | 194/97 A |
| 4,089,400 | 5/1978 | Gregory | 194/97 A |
| 4,333,557 | 6/1982 | Kozak | 194/97 A |
| 4,336,854 | 6/1982 | Jensen | 338/32 H X |

*Primary Examiner*—F. J. Bartuska

[57] ABSTRACT

A coin testing device having a substantially vertical coin chute with facility for testing coin size, central opening, topography and metal content while the coin is substantially traveling in free fall. Testing elements are located on the same side of the coin chute. The Hall effect is utilized to detect magnetic content.

12 Claims, 5 Drawing Figures

DEVICE FOR DETECTING AND REJECTING INVALID COINS UTILIZING A VERTICLE COIN CHUTE AND MULTIPLE COIN TESTS

BACKGROUND OF THE INVENTION

The present invention relates generally to coin testing apparatus for discriminating between genuine and non-genuine coins, tokens and the like and more particularly to coin testing devices suitable for use with gaming devices.

Gaming devices such as slot machines require a device known as a coin acceptor to detect and signal insertion of a valid token or coin to render the gaming device operable. Coin acceptors for gaming devices preferably perform several functions. These include detection of the proper size and weight of the coin, the insertion of a counterfeit coin or slug (by checking for metallic content and/or diameter interruption) and in the case of multiple coin machines, detection of a cheating method commonly referred to as "stringing".

Numerous types of coin testing devices are available but many are inappropriate for use in the gaming industry because the testing procedures require too much time to complete. With existing mechanical coin acceptors, the coin is usually weighed with a rocker arm with a counterbalance and then bounced off some type of small anvil. Mechanical acceptors typically discourage stringing with a gravity gate that can jam. Also, mechanical acceptors become dirty in a short period of time. Rocker pivot shafts and anvils wear out. These problems require a great deal of continued maintenance. Moreover, as the mechanical acceptors wear, they become less accurate and the acceptance of slugs increases.

Some acceptors attempt to determine mass of a coin with an oscillator circuit. Mass detecting oscillators have the drawback that they tend to accept slugs and washers.

A number of electronic coin acceptors have been developed which use the principles of induction, mutual induction, inductive reactance and/or capacitive reactance to perform various tests (for example, to test for velocity and acceleration) but such method require complicated and correspondingly costly apparatus. Some also utilize rotating discs or tables to rotate magnetic fields or the coin itself as a part of the coin testing procedure, thereby tending to slow down the process. Others utilize meandering or circular coin tracks, inclined planes or ramps to perform dimensioning and other tests which also tend to slow down the testing procedure. In consequence of the jamming potential, some of these acceptors must have provision for opening of the coin track, adding to the complexity and cost.

Other coin detectors incorporate light responsive detectors serving as switches to open and close various circuit elements. Typically, the light source and sensor units are located on opposite sides of the coin track requiring a somewhat complicated mechanical configuration and add cost and difficulty in the manufacture of the units.

SUMMARY OF THE INVENTION

A principle object of the present invention is to provide a coin acceptor of simple construction which will provide a fast test time and jam-free operation.

The coin acceptor of the present invention utilizes a vertical coin chute or path, and performs the necessary tests without slowing the movement of a coin (genuine or non-genuine) thereby enabling the coin undergoing test to move down the chute substantially in free fall under the influence of gravity, a very desirable feature in the gaming industry.

The testing elements of the coin acceptor of the present invention comprise electronic components with testing stations located substantially all on one side of the coin travel path, thereby simplifying construction and minimizing costs.

The coin acceptor incorporates a light emitting and sensing arrangement to examine the coin for size, reflectivity, topography and absence of a central opening (i.e., uninterrupted diameter) as it traverses the vertical travel path. Among the sensing signals produced are a timing signal and a pulse signal that are used to respectively set and increment an electronic counting circuit with the premise being that a valid coin or token will have a topography that will result in an electrical count of pulses that falls between certain predetermined numbers for the duration of the timing signal.

Because of the timing function provided by virtue of the timing signal and the substantially free fall condition of the coin falling down the coin chute, the coin acceptor of the present invention is able to check for various methods of cheating, such as stringing or coin bouncing (i.e., cheating techniques which require alteration of the speed of the coin through the acceptor).

A more particular, but important, aspect of the invention resides in the utilization of a lockout circuit for preventing the acceptor from accepting any coin if the coin-operated machine is inoperative or if the demand for coin is satisfied.

Another aspect of the invention relates to the utilization of a Hall Effect device working in conjunction with a small permanent magnet to check the coin for ferrous content without need to slow the movement of the coin, whether genuine or fake.

The coin acceptor of the present invention is of compact size and configuration, thereby enhancing ease of installation. Manufacturing cost is minimized in that the electronic circuit components are mounted to a common PC board affixed to a molded coin chute defining body section, and cooperating back plate with the only moving part being a coin deflecting element comprising a solenoid armature in the preferred embodiment disclosed herein.

Other features and advantages of the invention will be apparent from the following description and claims, and are illustrated in the accompanying drawings which show structure embodying preferred features of the present invention and the principles thereof, and what is now considered to be the best mode in which to apply these principles.

DETAILED DESCRIPTION

Figure 1:
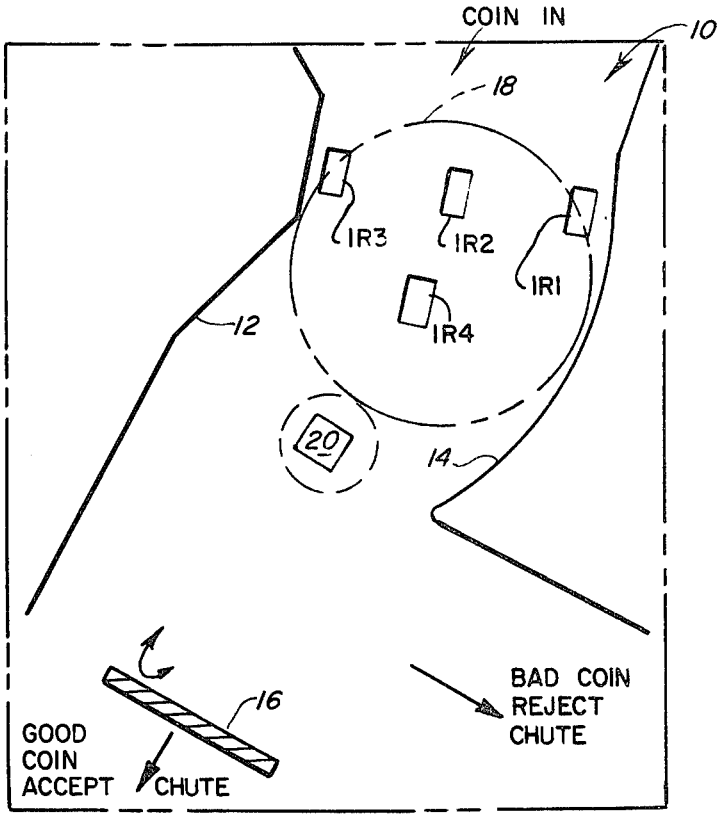
FIG. 1 is a schematic showing the coin travel chute and illustrating the locations of the infrared sensors and Hall Effect unit.

With reference now to the drawings, and specifically to FIG. 1, the coin acceptor of the present invention provides a substantially vertical travel path 10 defined by path forming surfaces 12 and 14. A movable deflector element 16 is normally maintained in blocking relation to the coin track to serve as a coin deflecting wall to deflect the coin to the left in FIG. 1 toward a coin reject chute as indicated by the arrow, and is lifted from the track to permit passage of a coin 18 toward a coin accept chute in the direction indicated by the arrow. Thus, the coin chute or track, considered as a whole, is shaped generally like an inverted letter "Y" with the base stem of the "Y" being slightly canted from the vertical so that a coin passing along the track tends to exit toward the coin accept chute unless, of course, deflector element 16 is located in its normal chute blocking position for deflecting coins toward the reject chute.

In the presently preferred embodiment illustrated herein three infrared detector assemblies IR1, IR2 and IR3 are located near the top of coin track in a straight line at a 90° angle to the direction of travel. Infrared assemblies IR1 and IR3 are placed to sense the outside dimensions of the coin while assembly IR2 is placed in the center of the track to sense the central portion of the coin. A fourth infrared detector assembly IR4 is located in the center of the coin track below assemblies IR1, IR2 and IR3. A Hall Effect unit 20 and its associated permanent magnet 22 are located on opposite sides of the coin chute below infrared assembly IR4 near the center of the coin track just above the portion of the track which forks to define the inverted "Y" shaped configuration.

As will be described, a total of five tests are conducted as the coin travels the coin chute. At the outset, the coin is tested for proper size, reflectivity and for absence of a washer hole. Secondly, the coin is tested to determine whether it possesses the necessary topography. Thirdly, the rate of travel of the coin is measured to determine whether it is free falling (i.e., tested to determine whether its being subjected to "stringing"). Fourth, the coin is tested to determine whether it has a ferrous metal content. A fifth test is actually not made on the coin, but rather constitutes a test to determine whether the machine is operating and/or has satisfied its coin requirements.

The operation of the coin acceptor will now be described with reference to the circuit diagram of FIG. 2.

Figure 2:
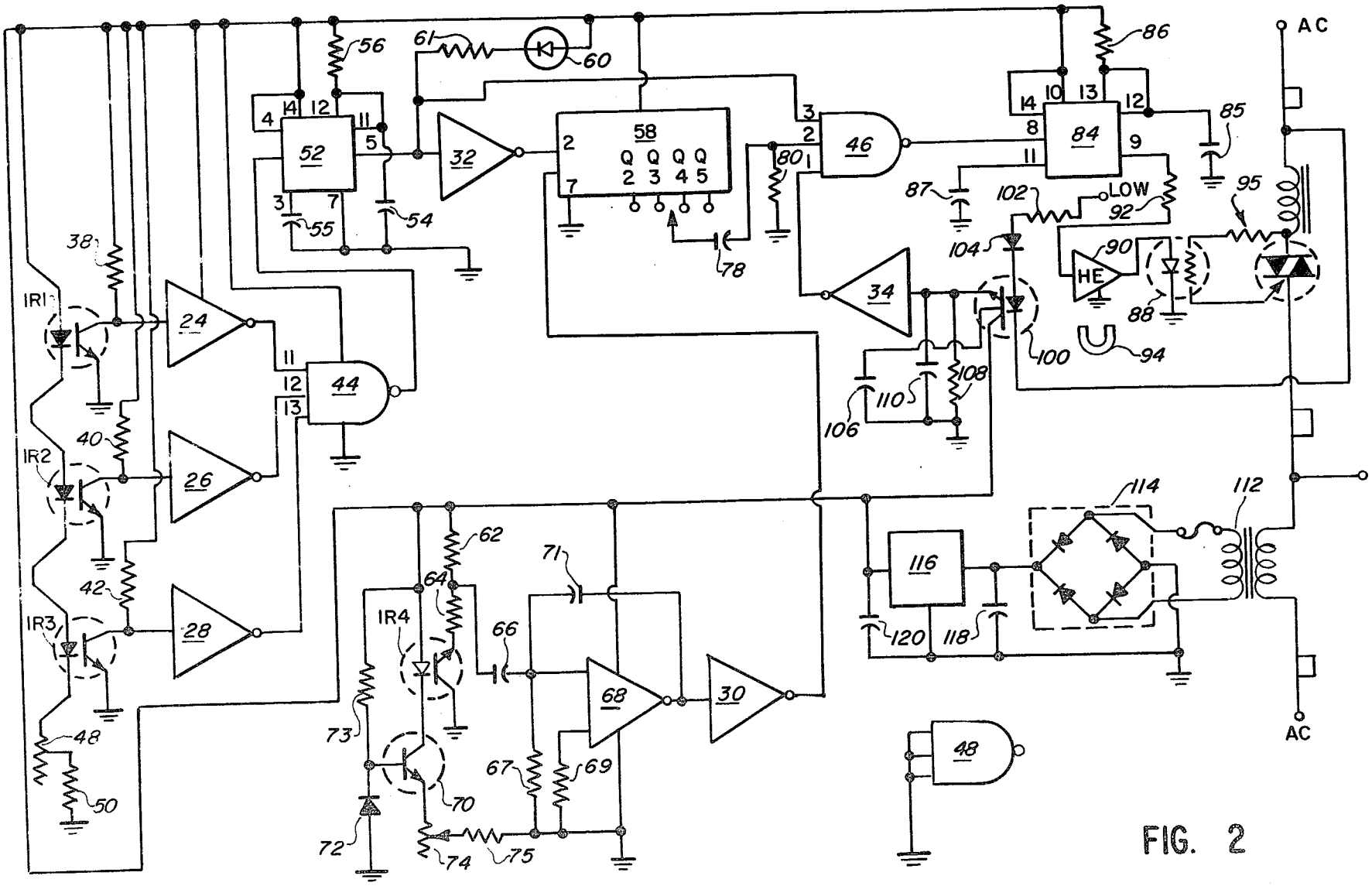
FIG. 2 is a circuit diagram for a coin acceptor in accordance with the invention.

As illustrated in FIG. 2, the collectors of infrared sensor assemblies IR1, IR2 and IR3 (each comprising a light emitting diode and associated photosensitive transistor) are connected to an integrated circuit (IC 14584) comprising six separate Schmitt trigger inverters, depicted in FIG. 2 as inverters 24, 26, 28, 30, 32 and 34. More specifically, the collector of assembly IR1 is connected to the input of inverter 24, the collector of assembly IR2 is connected to the input of inverter 26, and the collector of assembly IR3 is connected to the input of inverter 28. The inputs of inverters 24, 26 and 28 are also connected to a Vcc voltage line 36 through pull-up resistors 38, 40 and 42. The pull-up resistors 38, 40 and 42 cause the output state of inverters 24, 26 and 28 to be in a 0 or low condition. A coin passing in front of the infrared light emitted from the light emitting diodes reflect the same to the associated photosensitive transistors. The reflected light will cause the latter to conduct. The conduction of the photosensitive transistors will drop the pull-up voltage across the pull-up resistors 38, 40 and 42 to cause the outputs of the inverters 24, 26 and 28 to switch to a 1 or high.

The outputs of inverters 24, 26 and 28 are each connected to the input gates of a triple Nand gate (IC 14023), which is illustrated in FIG. 2 as gate sections 44, 46 and 48. More specifically, the outputs of inverters 24, 26 and 28 are each connected to the inputs of Nand gate section 44, the output state of which is normally 1 or high. A coin passing infrared assemblies IR1, IR2 and IR3 of the proper size and reflectivity will cause the output of Nand gate section 44 to change state and go to a 0 or low. As the coin continues to fall through the chute, it will move past infrared assemblies IR1 and IR3 causing the output of Nand gate section 44 to return to the normal 1 or high state.

As illustrated, the light emitting diodes of infrared assemblies IR1, IR2 and IR3 are connected in a series circuit from Vcc line 36 to ground through variable resistor 48 and resistor 50. Adjustment of variable resistor 48 will vary the intensity of the source infrared emission, such adjustment setting the threshold of the minimum reflectivity of the coin to be accepted.

The output of Nand gate section 44 is connected to the input of a timer circuit 52. When the output of Nand gate section 44 goes to a low or 0, the output of a timer circuit 52 is placed in a high or 1 state for a period of time determined by a RC network comprising capacitor 54 and resistor 56. The period of time is calculated to be the time it takes the valid coin to travel past infrared assembly IR4.

The output of timer circuit 52 is connected to the reset of a counter circuit 58 (IC 14024) through inverter 32 and is further connected to one input of Nand gate section 46. A light emitting diode (LED) 60 is also connected to the output of timer 52. The purpose of LED 60 is to indicate that the coin has passed the size and reflectivity test by blinking when the output of timer 52 goes high.

As the coin travels past infrared assembly IR4, the topography of the coin surface is converted to a video type signal by a RCR network constituted by resistors 62 and 64 and capacitor 66. This signal is further amplified by operational amplifier 68 (TIL 321) and thereafter connected to counter 58 through inverter 30. Inverter 30 also converts the video type signal to a data type or pulse signal through the action of the Schmitt trigger circuit of IC 14584. A transistor 70 (2N 4401) and a diode 72 (IN 747) provide a constant current for the source section of infrared assembly IR4 while variable resistor 74 is provided for purposes of sensitivity adjustment.

The counter circuit 58 is a ripple counter and gives a high output on one of the Q outputs when a correct number of input pulses have been received at the input. This counter action will occur only when the reset line is at the high or 1 state. It is known that a certain type of genuine coin or genuine token will always result in a certain minimum count on the appropriate Q output as the coin falls past infrared assembly IR4. As discussed above, the coin must first pass the size and reflectivity test to activate timer 52 to place the reset line in the high or 1 state. The coin then must have a topography to increment the counter 58 to the proper Q output circuit by jumper 76.

The counter 58 must be incremented to the proper Q state during the time the reset line is set at 1 or high as determined by the output of timer 52, such being the time it takes the coin to free fall past infrared assembly IR4. This arrangement prevents cheating by means of coin stringing as the coin must travel at the free fall speed to achieve the proper count in the time the reset line is high. When timer 52 relaxes, the counter reset line goes to a low or 0 state thereby disabling counter 58 and returning all Q outputs to the low or 0 state. The counter 58 remains in the reset state until another coin falls through the coin entry and again passes the size and reflectivity tests, thereby reactivating timer 52.

The proper Q output of the counter 58 for the coin undergoing test is connected by means of jumper 76 to one of the inputs to Nand gate section 46 by means of a CR network comprising capacitor 78 and resistor 80 which couple the Q output pulse of the counter 58 to Nand gate section 46. Resistor 80 also holds the input of the Nand gate section 46 in a low or 0 state except when a high or 1 pulse is received from the Q output of counter 58.

Nand gate section 46 performs a further important accept-reject coin test, as will now be described. The Nand gate section 46 has three input gates, all of which must be in the high or 1 state to cause the output to go to a low or 0 state. Input gate 2 is connected to the output of timer 52 which is in a 1 or high state only when activated. Input gate 3 is connected to the appropriate Q output of counter 58 circuit which will produce a high or 1 pulse only if the topography of the coin being tested yields a sufficient number of pulses to increment the counter to the correct Q output. Input gate 1 is connected to a coin lockout circuit 82 (described hereafter) and is held in high or 1 state except when the machine to which the acceptor is attached signals the demand for coin is satisfied or is inoperable. When there is not a demand for coin input gate 1 goes to a low or 0 state, returning to a high or 1 state when the machine again signals a demand for coin.

If the coin being tested has the proper size and reflectivity, input gate 2 is made high by timer 52, and input gate 3 will pulse high if the coin has the topography to increment counter 58 to the correct Q output. The output of Nand gate section 46 will produce a low or 0 at the instant input gate 3 pulses high if input gates 1 and 2 are in the high or 1 state.

The output of Nand gate section 46 is connected to the trigger or input of a timer 84. The action of the output of Nand gate section 46 changing to a low or 0 state will cause timer 84 to activate. When timer 84 activates, its output will go to a high or 1 state for a period of time determined by a RC circuit comprising resistor 86 and capacitor 87, this period being the time it takes a coin to free fall past the coin gate solenoid armature 16 (FIGS. 1 and 3) and enter the machine.

The output of timer 84 is connected to an optical coupler 88 through Hall Effect device ("HE") 90 and resistor 92. If the coin is non-ferrous, the HE device 90 has no effect on the output signal from timer 84. If the coin is of a ferrous metal the output signal from timer 84 is conducted to ground. A small permanent magnet 94 is attached to the acceptor body on the opposite side of the coin track adjacent to the HE device to provide a magnetic flux path to activate the HE device.

If the output signal from timer 84 is not interrupted by HE device 90, optical coupler 88 will activate. The output coupler 88 will cause a bidirectional triac 96 (2N6071) to conduct. The triac 96 is connected in series with the coin gate solenoid 98. The activation of solenoid 98 allows the coin to fall through the accept side and enter the machine for credit by lifting the solenoid armature 16 from its chute blocking position.

As noted above, the lockout circuit 82 detects a voltage from the machine, signaling that the demand for coin is satisfied. This voltage is applied to optical coupler 100 through resistor 102 and diode 104. The output of coupler 100 is connected through inverter 34 to input gate 3 of Nand gate section 46.

Optical coupler 100 is a 4N31 type, which is an infrared source and a photo-transistor. As illustrated, the lockout signal from the machine is connected to the source through resistor 102 and diode 104, the purpose being to isolate the machine from the acceptor. The output of the coupler 100 is a photo-transistor, the collector of which is connected to the input of inverter circuit 34. The base is bypassed to ground through capacitor 106.

The input gate of inverter 34 is connected to ground through resistor 108 in parallel with capacitor 110 which form a filter network. Resistor 108 also holds the input gate of inverter circuit 14584-F in a low or 0 state except when the lockout signal is present.

The power supply consists of a step down transformer 112 which is mounted to the machine and connected to the acceptor through a power cable. The output of the transformer 112 is connected to a full-wave bridge rectifier 114 (type 920A2), the output of which is connected to a voltage regulator 116 (type MC-7905). Capacitors 118 and 120 compose the filter network.

Summarizing, infrared assemblies IR1 and IR3, inverters 24 and 28, and Nand gate section 44 serves is a first detector arrangement operable to detect passage of a coin having certain characteristics, namely a predetermined minimum diameter and surface reflectivity, and producing a first coin accept signal (i.e., the 0 or low output condition of Nand gate section 44). This first detector arrangement also is operable to detect passage of a coin having the characteristics of an uninterrupted diameter (i.e., absence of a washer hole) by virtue of infrared assembly IR2 and inverter 26.

Timer 52 and the associated RC network function as first circuit means responsive to the first coin accept signal (output of Nand gate section 44 in the illustrated embodiment) for producing a timing signal of predetermined duration (i.e., the time required for a coin to pass assembly IR4).

Infrared assembly IR4 and its associated circuit elements serve as a second detector arrangement for producing a coin topography representative signal (i.e., the output of inverter 30).

Counter 58 serves as second circuit means responsive to the timing signal for measuring the topography representative signal is of a predetermined characteristic (i.e., when the count of pulses within the measuring time is within a predicted range).

Finally, the circuit elements begining with Nand gate section 46 and ending at the solenoid constitute third circuit means responsive to the output signal (of counter 58) for controlling operation of coin deflector means (i.e., the In the preferred embodiment disclosed herein the following circuit parameters apply: solenoid armature 16 in the illustrated embodiment).

| Circuit Element(s) | Kind |
|---|---|
| Infrared Assemblies IR1–IR4 | TIL 149 |
| Pot 48 | var. to 200 ohms |
| Resistor 50 | 27 ohms |
| Resistors 38, 40, 42 | 220K ohms to 1 MEG |
| Inverter Sections 24, 26, 28, 30, 32 and 34 | MC 14584B |
| Nand Gate Sections 44, 46, 48 | MC 14023B |
| Timers 52, 84 | LM 556CN |
| Resistors 56, 86 | 10 MEG. |
| Capacitor 54 | .005 to .01 M |
| Capacitors 55, 66, 78, 85, 87, 110 | .01 M |
| LEDs 60 | TIL 228 |
| Resistor 61 | 180 ohms |
| Counter 58 | MC 14024B |
| Resistors 62, 64, 80, 108 | 100K ohms |
| Transistor 70 | 2N 4401 |
| Diode 72 | 1N 747 |
| Pot 74 | var. to 200 ohms |
| Resistor 75 | 100 ohms |
| Resistor 73 | 1K ohms |
| Operational Amplifier | TIL 321 |
| Resistors 67, 69 | 10K ohms |
| Capacitor 71 | 150 Pf |
| Resistor 92 | 180 ohms |
| HE 90 | UGN 3006 |
| Coupler 88 | VTL SCI |
| Triac 96 | 2N 6051 |
| Resistor 95 | 4.7K ohms |
| Solenoid 98 | 50 VAC |
| Coupler 100 | 4N 31 |
| Capacitor 106 | 150 Pf |
| Rectifier 114 | 920A2 |
| Transformer 112 | Signal 241-4-20 |
| Regulator 116 | MC 7905 |
| Capacitor 118 | 500 MFD |
| Capacitor 120 | 100 MFD |

As noted previously, pots 48 and 74 are set in accordance with the reflective characteristics of the coin or token expected to be tested. In general the brighter the coin the higher the resistivity setting. By way of example, for a fifty cent piece (U.S.), pot 48 is set at approximately 50 ohms and pot 74 at 200 ohms. For a brass token, ports 48 and 74 are both set at 50 ohms. For an Eisenhower dollar piece, pot 48 is set at 25 ohms and pot 74 at 100 ohms.

Figure 4:
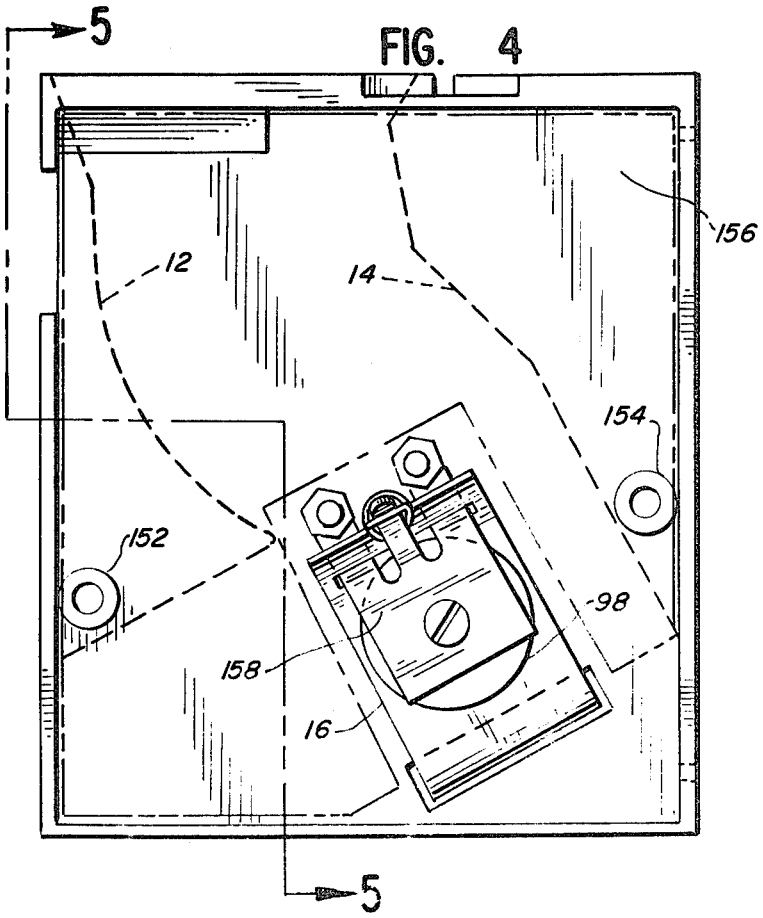
FIG. 4 is a plan view of the coin acceptor with the circuit board shown in phantom.
Figure 5:
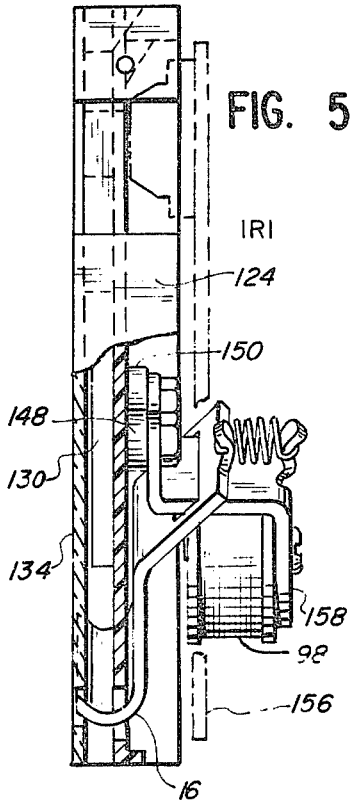
FIG. 5 is a side elevation, partly in section as indicated by the line 5—5 of FIG. 4, of a coin acceptor, the electronic circuit board and infrared assemblies being illustrated in phantom.
Figure 3:
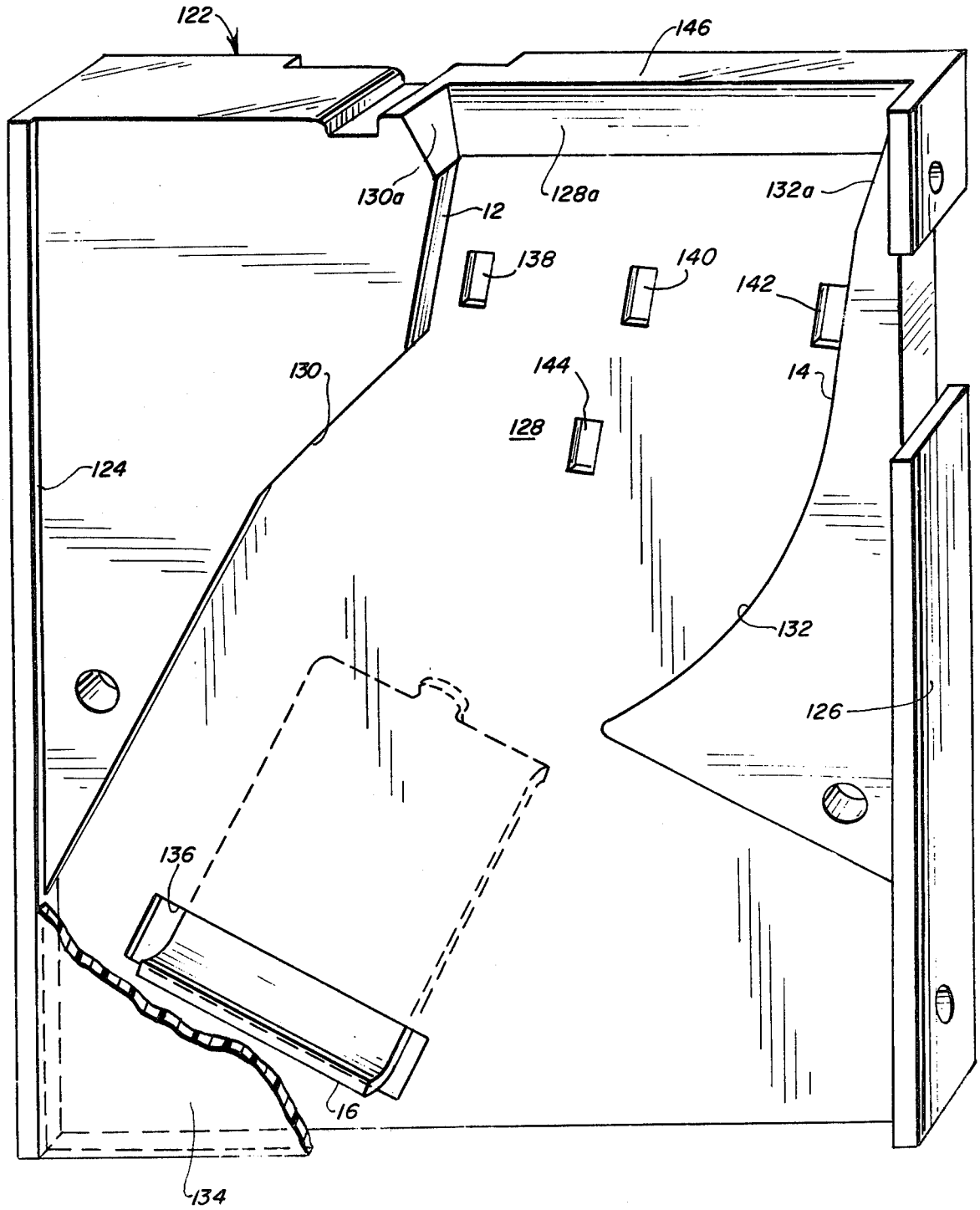
FIG. 3 is a perspective view showing the coin acceptor body and portions of the back plate.

With reference to FIGS. 3 and 4 the coin acceptor embodiment disclosed herein includes a main body section 122 of molded plastic material having opposed side walls 124 and 126. A transverse wall 128 extends between the side walls 124 and 126 and merges therewith approximately mid-width thereof. The coin chute is formed by guide walls 130 and 132 projecting outwardly from transverse wall 128. Guide walls 130 and 132 respectively define the confronting coin path defining surfaces 12 and 14 discussed previously with reference to FIG. 1. The coin chute is further defined by the portion of transverse wall 128 which extends between and below guide walls 130 and 132 and a corresponding portion of a non-metallic back plate 134 suitably affixed across the front of the main body section 122. The transverse wall is provided with an opening 136 to permit access for the solenoid armature 16 which serves as the coin deflector element discussed previously, and is further provided with openings 138, 140, 142 and 144 to permit viewing by the infrared assemblies IR1, IR2, IR3 and IR4, respectively.

The top end of the main body 122 is configured to define a coin entry. To this end the upper regions 128*a*, 130*a* and 132*a* of the transverse wall 128 and guide walls 130 and 132 flair outwardly to form a funnel. A top wall 146 is split at portion 146*a* thereof to accomodate connection of the coin acceptor chute to the main coin chute of the machine.

Completing the main body section, the side of transverse wall 128 opposite the coin chute side is provided with a first pair of mounting pedestals 148 and 150, and a second pair of mounting pedestals 152 and 154.

A PC board 156, mounting the electronic components, is secured to the second pair of mounting pedestals to extend in spaced parallel relation to transverse wall 128.

Completing the coin acceptor, a mounting bracket 158 connected to the first pedestals 148 and 150 supports the coil coin gate solenoid 98 above the solenoid armature 16 (a suitable opening being provided in the PC board). For purposes of supporting and biasing the solenoid armature 16 so that its coin deflecting portion is normally in a coin chute blocking position (i.e., as shown in FIGS. 1–4), the opposite end thereof is provided with pivot opening 16*a* through which legs 158*a* and 158*b* of bracket 158 extend and is connected by bias spring 160 to arm 162 of the bracket.

Typically, transformer 112 is not affixed to the coin acceptor itself although, optionally, it can be. The remaining circuit elements described with reference to FIG. 2 are affixed to PC board 156 (except for the solenoid 98 and armature 16). Permanent magnet 94 may be affixed to the back plate 134 or, optionally, to the machine so long as it is positioned so that the flux path is as described above.

Thus, while preferred constructional features of the invention are embodied in the structure illustrated herein, it is to be understood that changes and variations may be made by those skilled in the art without departing from the spirit and scope of the appended claims.

What is claimed is:

1. In a coin acceptor having a coin chute including coin entry and discharge ends and coin deflector means at the discharge end operable between coin accept and reject positions, the combination comprising first detector means disposed along said chute for detecting passage of a coin having predetermined physical characteristics, including predetermined diameter and surface reflectivity, and producing a first coin accept signal in response thereto, first circuit means including timing means responsive to said first coin accept signal for producing a timing signal of predetermined duration, second detector means disposed along said chute for detecting the topography of the side of a coin and producing a coin topography representative signal, second circuit means responsive to said timing signal for measuring said representative signal for said predetermined duration and producing an output signal when said representative signal is of a predetermined characteristic, third circuit means responsive to said output signal for operating said coin deflector means, third detector means disposed along said chute for detecting presence of magnetic material in a coin moving along said chute, said third detector means being connected to control said third circuit means to cause said deflector means to be at said deflecting position upon detection of said magnetic material, said third detector means including a permanent magnet disposed on one side of said chute and cooperating means disposed on the opposite side of said chute adjacent said magnet for measuring the Hall Effect produced by a coin moving along said chute therebetween.

2. In a coin acceptor in accordance with claim 1 wherein said predetermined physical characteristics further include the absence of a washer hole in a coin moving along said chute.

3. In a coin acceptor in accordance with claim 1 wherein said first detector means includes first light emitting means and associated first light sensitive means disposed along said chute in position to direct light toward at least one of the opposed side edge regions of said chute to be reflected by the side edge region of a coin of predetermined minimum diameter moving along said chute and sensed by said first light sensitive means.

4. In a coin acceptor in accordance with claim 2 wherein said first detector means includes first light emitting means and associated first light sensitive means disposed along said chute in position to direct light toward at least one of the opposed side edge regions of said chute to be reflected by the side edge region of a coin of predetermined minimum diameter moving along said chute and sensed, by said first light sensitive means, and second light emitting means and associated second light sensitive means disposed along said chute in position to direct light toward a central portion of said chute at a point substantially equidistant therealong as said one of the opposed edge regions to be reflected by the central side region of said coin and sensed by said second light sensitive means.

5. In a coin acceptor in accordance with claim 2 wherein said second detector means includes separate light emitting and associated separate light sensitive means disposed along said chute downstream from said first light emitting and associated first light sensitive means in position to direct light toward the central portion of said chute to be reflected by the side surface of said coin and sensed by said separate light sensitive means.

6. In a coin acceptor in accordance with claim 5 wherein said second detector means further includes circuit means for converting the output of said separate light sensitive means to a pulse signal, the number and spacing of the pulses of which vary in accordance with the topography of said coin.

7. In a coin acceptor in accordance with claim 6 wherein said second circuit means includes counter means, said counting means being responsive to said timing signal to initiate counting of the pulses of said pulse signal and operable to produce said output signal upon reaching a predetermined count within the duration of said timing signal.

8. In a coin acceptor in accordance with claim 1 and further including lockout means for producing a lockout signal when there is no demand for coin acceptance, said lockout circuit being connected to control said third circuit means to cause said coin deflector means to be at the coin reject position in the absence of coin demand.

9. In a coin acceptor in accordance with claim 1 wherein said predetermined duration is the time required for a valid coin to free fall past said second detector means.

10. In a coin acceptor in accordance with claim 1 wherein said topography representative signal comprises a pulse signal.

11. In a coin acceptor in accordance with claim 1 wherein said coin deflector means includes a solenoid armature movable between a coin chute blocking location and coin chute unblocking location.

12. In a coin acceptor in accordance with claim 3 wherein said first light emitting means and associate first light sensitive means are disposed on the same side of the coin chute.

* * * * *